US006883239B2

(12) United States Patent
Sato

(10) Patent No.: US 6,883,239 B2
(45) Date of Patent: Apr. 26, 2005

(54) HAIR TRIMMING DEVICE

(75) Inventor: Fumihiko Sato, C/-Leong C. Lei, PMB#1008, 1867 Ygnacio Valley Rd., Walnut Creek, CA (US) 94598-3214

(73) Assignees: Fumihiko Sato, Tokyo (JP); Yoshiya Oura, Tokyo (JP)

( * ) Notice: Subject to any disclaimer, the term of this patent is extended or adjusted under 35 U.S.C. 154(b) by 0 days.

(21) Appl. No.: 10/650,801

(22) Filed: Aug. 29, 2003

(65) Prior Publication Data

US 2005/0044723 A1 Mar. 3, 2005

(51) Int. Cl.[7] ..... B26B 13/04

(52) U.S. Cl. ..... 30/236; 30/234; 30/253

(58) Field of Search ..... 30/30, 43, 51, 30/53, 131, 134, 194, 195, 233.5, 234, 236, 30/253, 331; 132/213; D28/52

(56) References Cited

U.S. PATENT DOCUMENTS

| | | | | | |
|---|---|---|---|---|---|
| 240,953 | A * | 5/1881 | Bogard | 30/236 |
| 297,327 | A * | 4/1884 | Wickenden | 30/234 |
| 523,136 | A * | 7/1894 | Trakofler | 294/99.2 |
| 714,087 | A * | 11/1902 | Woods | 30/234 |
| 2,678,047 | A * | 5/1954 | Garfield | 132/219 |
| 2,849,793 | A * | 9/1958 | Cordaro et al. | 30/30 |
| 3,972,333 | A * | 8/1976 | Leveen | 606/174 |
| 6,092,288 | A * | 7/2000 | Adachi | 30/53 |
| 6,317,987 | B1 * | 11/2001 | Joung | 30/236 |

* cited by examiner

*Primary Examiner*—Hwei-Siu Payer
(74) *Attorney, Agent, or Firm*—Leong C. Lei

(57) ABSTRACT

A hair-trimming device is disclosed. The device comprises a substantially U-shaped member having a first handle portion and a second handle portion and an elastic portion alloy the first handle portion and the second handle portion to elastically separated; a pair of razor-fastener connected to the ends of the first and second handle and one lateral edge of the razor fastener being longitudinally mounted with razor with protective cover; and a stop mounted across the first handle and the second handle such that the handles are restricted to open to an excessive scope.

5 Claims, 5 Drawing Sheets

HAIR TRIMMING DEVICE

BACKGROUND OF THE INVENTION (a) Technical Field of the Invention

The present invention relates to a hair-trimming device, and in particular, a hair-trimming device having two handles with both ends mounted with razor-mounting portions.

(b) Description of the Prior Art

In order to obtain a neat and well-groomed appearance, a person needs a good hair-trimming device to trim his hair occasionally. Presently, there are trimmers available which are available in the market. Commonly, these trimmers have a cutting head (in which one blade reciprocates against another) that is fixed in a single position and extends from the front of the unit. For cutting the hair to a uniform length, one may use an attachment comb that spaces the cutting head from the skin by a specified distance. Typically, it is suggested that the trimmers be used to cut the hair against the grain, i.e., opposite to the direction in which the hair naturally grows. One problem with many currently available trimmers relates to the relationship between the cutting head and the handle (or main body) of the unit. Oftentimes the user must position his hand and arm in potentially uncomfortable or awkward positions in order to have the cutting head aligned in the desired position with the face and/or the neck.

SUMMARY OF THE INVENTION

Accordingly, it is an object of the present invention to provide a hair-trimming device, a substantially U-shaped member having a first handle portion and a second handle portion and an elastic portion alloy the first handle portion and the second handle portion to elastically separated; a pair of razor-fastener connected to the ends of the first and second handle and one lateral edge of the razor fastener being longitudinally mounted with razor with protective cover; and a stop mounted across the first handle and the second handle such that the handles are restricted to open to a certain degree.

Yet another object of the present invention to provide a hair-trimming device, wherein one end of the stop is secured to one of the handles so that when the handles approach each other, the stop is positioned at one of the handle.

Still another object of the present invention is to provide a hair-trimming device, wherein screws are used to mount the razor-fasteners onto the end of the handle.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
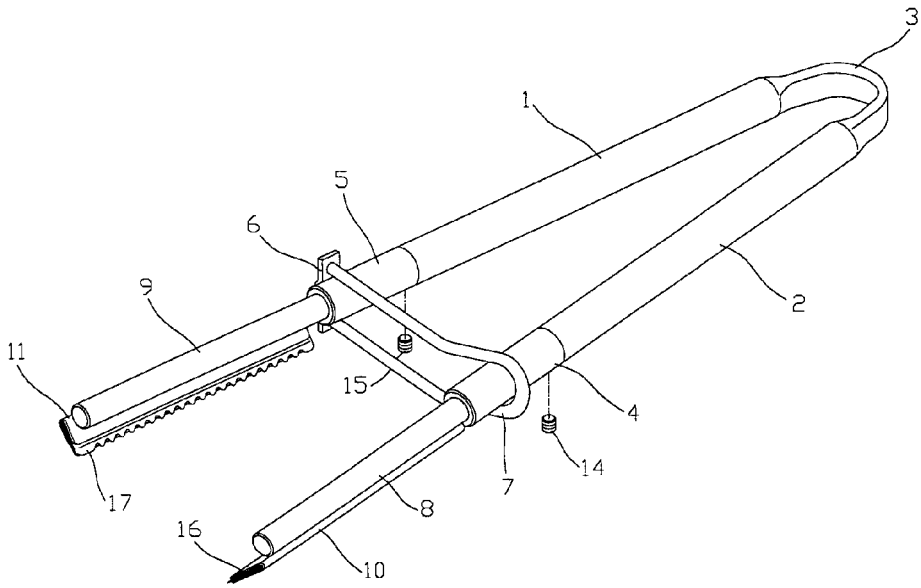
FIG. 1 is a perspective view of a hair-trimming device of the present invention.
Figure 4A:
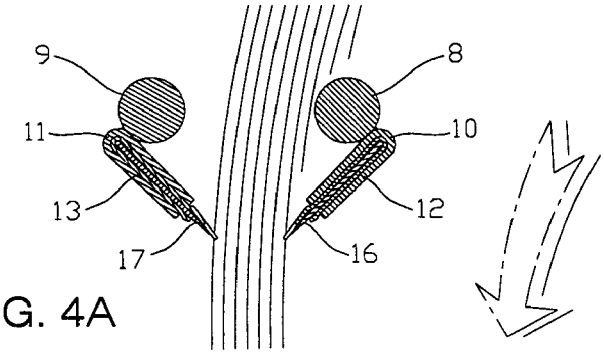
FIGS. 4A, 4B are schematic views showing the trimming of straight hair in accordance with the present invention.
Figure 4B:
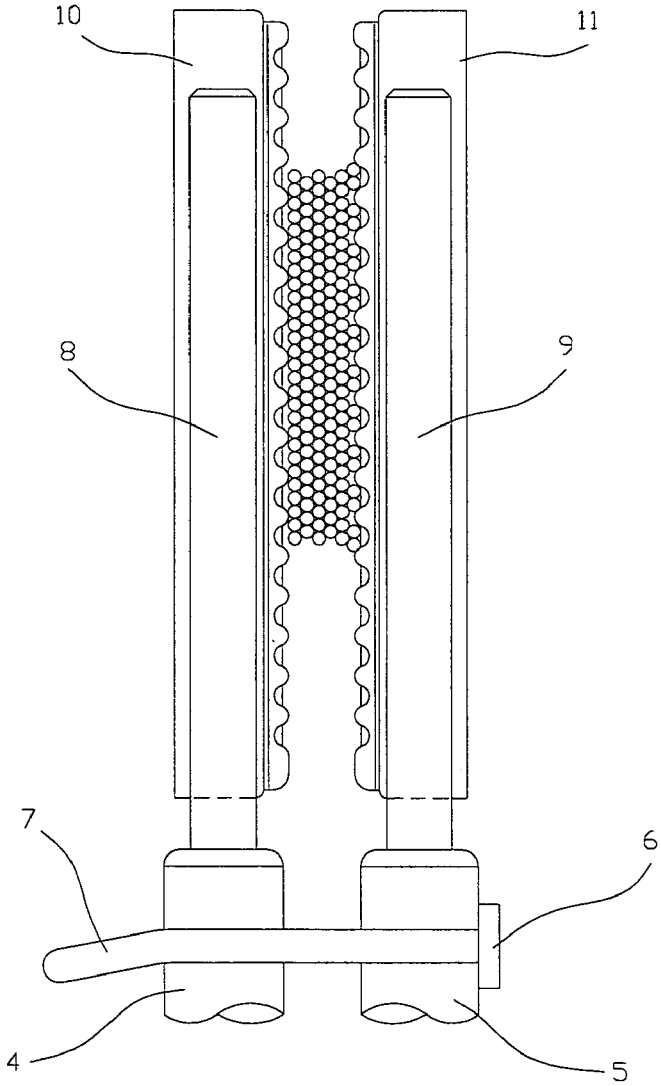
Figure 5:
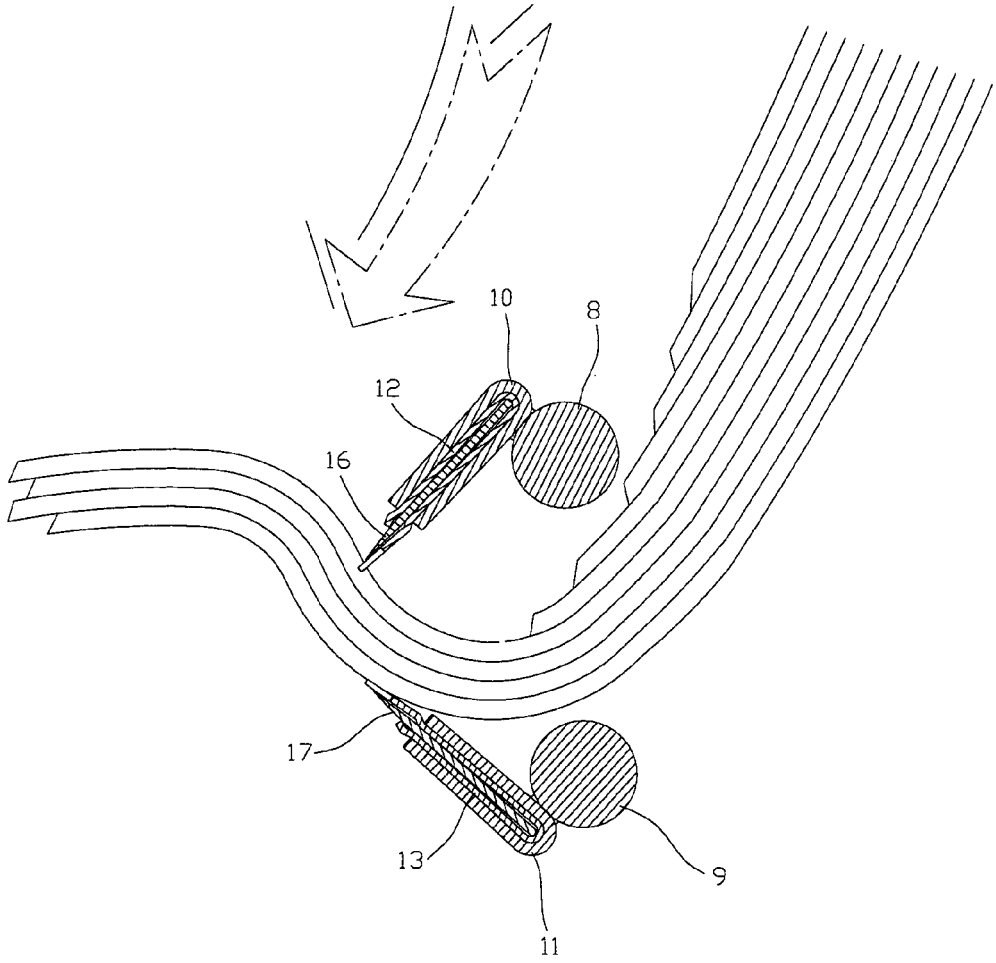
FIG. 5 is a schematic view showing the trimming of curved hair in accordance with the present invention

Referring to FIG. 1, there is shown a hair-trimming device having handle portions 1, 2 covered with metallic layer and having an elastic portion 3. The handle portions 4, 5 are without anti-sliding cover. The front end of the handle portion is a tubular body with a recess, and one side of the tubular body is provided with screw holes for mounting with securing screws 14, 15. Razor-fastener 8, 9 are mounted to the ends of the handles 1, 2. A stop 6 is mounted across the handle 1, 2 so as to restrict excessive opening of the handle 1, 2. The edges of the razor-fasteners 8, 9 are provided with safety covers 12, 13 (see FIG. 4A and FIG. 5) for the razor-mounting portions 10, 11.

Figures 2A, 2B:
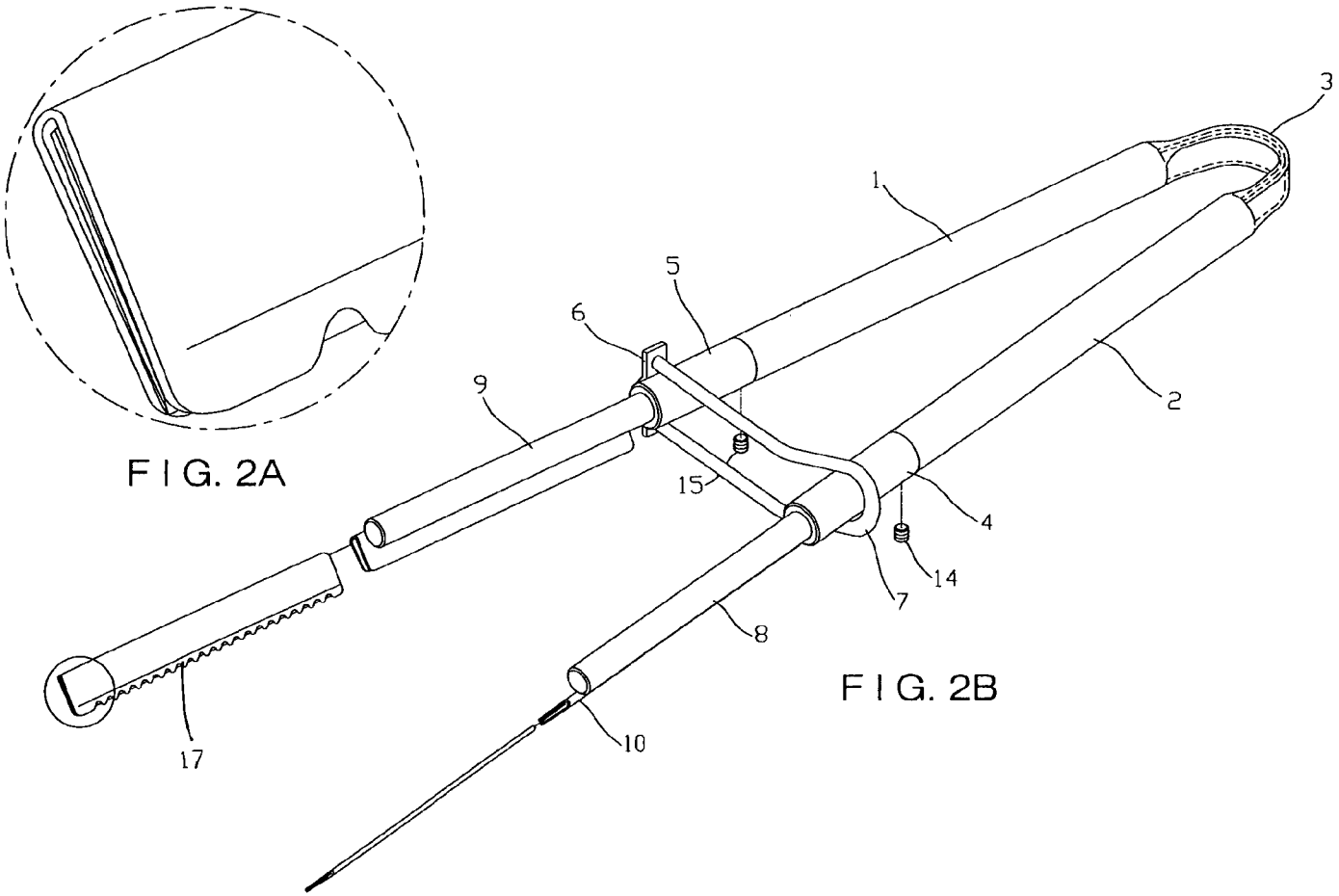
FIG. 2A is an enlarged view of the razor-mounting section of the preferred embodiment of the present invention.
FIG. 2B is an enlarged view of a potion of FIG. 2A.
Figure 3A:
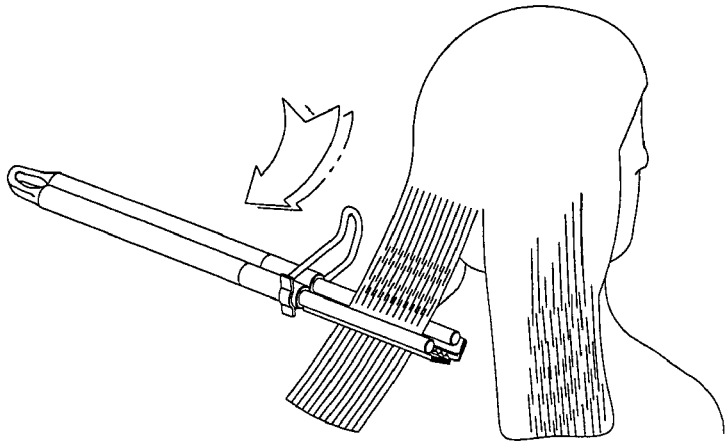
FIGS. 3A, 3B, 3C are schematic views showing the trimming of hair in accordance with the present invention.
Figure 3B:
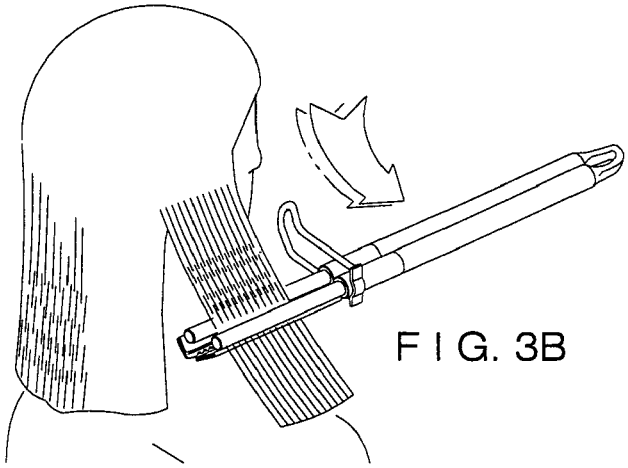
Figure 3C:
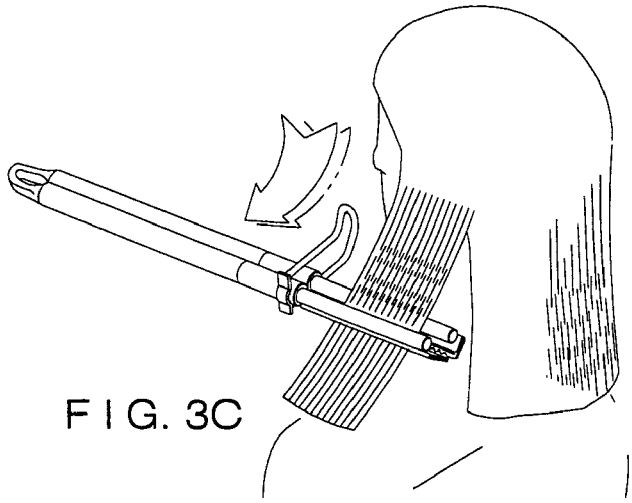

Referring to FIGS. 2A, 2B, there is shown an enlarged view of the razor-mounting portion, wherein the safety cover is released. The lower sections of the handles 4, 5 are provided with screw holes for the mounting of screws 14, 15 together with the razor-fasteners 8, 9 onto the handles 1, 2. The front ends of the handles 1, 2 are provided with a recess. The razor-mountings 10, 11 are provided at the side of the razor-fasteners 8, 9. Razors 16, 17 (see FIG. 4A) with protective cover 12, 13 are inserted into the gap.

The use of the hair-trimming device is shown in FIGS. 3A, 3B, 3C, 4A, 4B and FIG. 5, wherein a hand holds the hair and the hair-trimming device is dragged along the hair and hairs are thus trimmed.

The advantages of the hair-trimming device of the present invention are that:

(1) Gap is formed between the interlocking of the razor and thus, the hair that to be retained will not be trimmed.

(2) Not extra force has to apply to the hair-trimming device for the reason that the weight of the hair-trimming device can smoothly cut the hair.

(3) The hair-trimming device allows hair to be trimmed in dual direction.

(4) The hair-trimming device allows the hair to be trimmed in an ideal angle.

(5) One side of the razor can be used.

(6) The hair-trimming device does not need to be moved a long distance to trim hair. Only moves the hair-trimming device around hairs, the hair can thus be trimmed.

(7) The hair-trimming device can trim the hair into any style.

(8) The hair-trimming device allows the trimming of curved hair.

In accordance with the present invention, the hair-trimming device is fabricated as follows:

Stainless steel of width 3.2 cm and 28 cm of length having an elastic portion of dimension 1.1 cm width and about 5 cm in length is made into a U-shaped structure. The ends of the structure are provided with lower terminal of 2 cm. The other length of the structure except the elastic portion is covered with rubber. At about 1 cm from the end of the 2 cm lower terminal, screw holes are provided so as to install two handle portions 1, 2.

A stop 6 is welded to one of the handle 8 and the stop 6 is about height 1.5 cm, width 0.9 cm and a thickness of 0.2 cm. A U-shaped member 7 of length 9 cm and diameter of 0.3 cm is welded on to the stop 6. The other handle of the hair-trimming device passes through the U-shaped member 7.

A razor-fastener 8, 9 that is made from stainless steel of diameter 0.6 cm, length 9 cm, is provided with a screw hole at one end of the fastener. Razor mounting portions 10, 11 are welded to the razor-fastener 8, 9 as shown in FIG. 2B. Finally the razor-fastener 8, 9 are inserted into the front screw hole and are fastened with screws.

Next, the razors 16, 17 with protective covers 12, 13 are inserted into the razor-mounting portions 10, 11 and the structure is formed into a hair-trimming device.

In accordance with the present invention, the hair-trimming device can be used conveniently and the razor can be replaced easily and the angle of operation is not limited. It is a safe hair-trimming device in accordance with the present invention.

In accordance with the present invention, the two handles are separated by an elastic member and one of the handles is mounted with a stop to avoid excessive opening of the handles of the hair-trimming device.

The hair-trimming device of the present invention is made from stainless steel. In accordance with the present invention, the method of manufacturing the hair-trimming device is as follows:

(1) cutting a stainless steel to form two handles;

(2) forming an elastic portion and connecting the elastic portion at one ends of the handle to form a substantially U-shaped member;

(3) mounting a stop to one of the handle;

(4) forming a razor-mounting fastener onto the handle at one end and securing with screws; and (5) mounting razor to the razor-mounting fastener to form the hair-trimming device.

In accordance with the present invention, the hair-trimming device is an effective tool in hair-trimming and has the following advantages (1) it can be easily operated;

(2) the replacement of razor is simple;

(3) the hair-trimming device can treat all kind of hair to any style.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A hair-trimming device comprises:

(a) a substantially U-shaped member having a first handle portion and a second handle portion and an elastic portion alloy the first handle portion and the second handle portion to be elastically separated;

(b) a pair of razor-fasteners connected to the ends of the first handle portion and the second handle portion and one lateral edge of each razor-fastener being longitudinally mounted with a razor with a protective cover; and (c) a stop mounted across the first handle portion and the second handle portion such that the handle portions are restricted to open to a certain degree.

2. The hair-trimming device of claim 1, wherein one end of the stop is secured to one of the handle portions so that when the handle portions approach each other, the stop is positioned at one of the handle portions.

3. The hair-trimming device of claim 1, wherein screws are used to mount the razor-fasteners onto the ends of the handle portions.

4. The hair-trimming device of claim 2, wherein the stop is welded onto one of the handle portions.

5. The hair-trimming device of claim 1, wherein the razors at the handle portions are interlocked to each other when the handle portions approach each other.

* * * * *